US006997638B2

(12) United States Patent
Hensley et al.

(10) Patent No.: US 6,997,638 B2
(45) Date of Patent: Feb. 14, 2006

(54) ANTI-TERRORIST ROAD BLOCK

(75) Inventors: Clifford J. Hensley, Odessa, TX (US); Robert C. Herrin, Odessa, TX (US); David L. Stice, Odessa, TX (US); Robert L. Sims, Odessa, TX (US)

(73) Assignee: Perimeter Defense Technologies LPO, Midland, TX (US)

( * ) Notice: Subject to any disclaimer, the term of this patent is extended or adjusted under 35 U.S.C. 154(b) by 0 days.

(21) Appl. No.: 10/635,724

(22) Filed: Aug. 5, 2003

(65) Prior Publication Data

US 2005/0031411 A1 Feb. 10, 2005

Related U.S. Application Data

(60) Provisional application No. 60/403,997, filed on Aug. 17, 2002.

(51) Int. Cl.
*E06B 11/00* (2006.01)
*E01F 15/00* (2006.01)

(52) U.S. Cl. ..... 404/6; 404/9; 49/49; 49/131

(58) Field of Classification Search ..... 404/6, 404/9, 10; 49/49, 131
See application file for complete search history.

(56) References Cited

U.S. PATENT DOCUMENTS

| | | | | |
|---|---|---|---|---|
| 3,086,430 | A | | 4/1963 | Emmel |
| 4,320,380 | A | | 3/1982 | Berard et al. |
| 4,576,508 | A | | 3/1986 | Dickinson |
| 4,666,331 | A | * | 5/1987 | Riley ..... 404/6 |
| 4,715,742 | A | | 12/1987 | Dickinson |
| RE33,201 | E | * | 4/1990 | Dickinson ..... 404/6 |
| 4,919,563 | A | | 4/1990 | Stice |
| 5,462,384 | A | | 10/1995 | Arlandis |
| 5,476,338 | A | * | 12/1995 | Alberts ..... 404/6 |
| 5,509,753 | A | * | 4/1996 | Thompson ..... 404/6 |
| 5,560,733 | A | | 10/1996 | Dickinson |
| 5,975,792 | A | | 11/1999 | Goeken et al. |
| 6,099,200 | A | | 8/2000 | Pepe et al. |
| 6,161,821 | A | | 12/2000 | Leno et al. |
| 6,312,188 | B1 | | 11/2001 | Ousterhout et al. |

* cited by examiner

*Primary Examiner*—Gary S. Hartmann
(74) *Attorney, Agent, or Firm*—Haynes and Boone, LLP

(57) ABSTRACT

A road block having an extensible bollard that is manually or electronically actuated by a powerful spring force for slow extension, and by both the spring and a power lift for rapid extension.

49 Claims, 5 Drawing Sheets

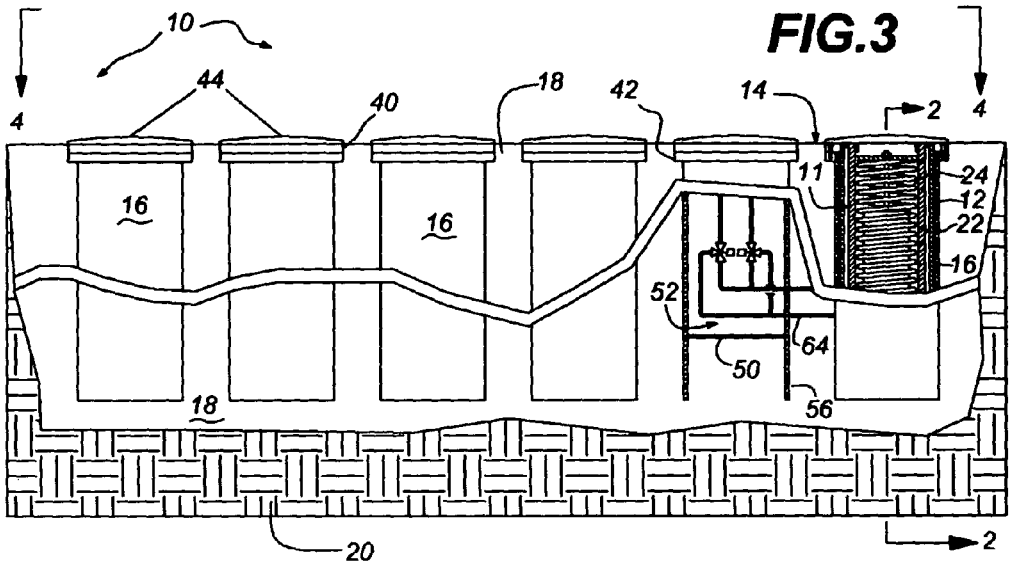
FIG.3
FIG.4
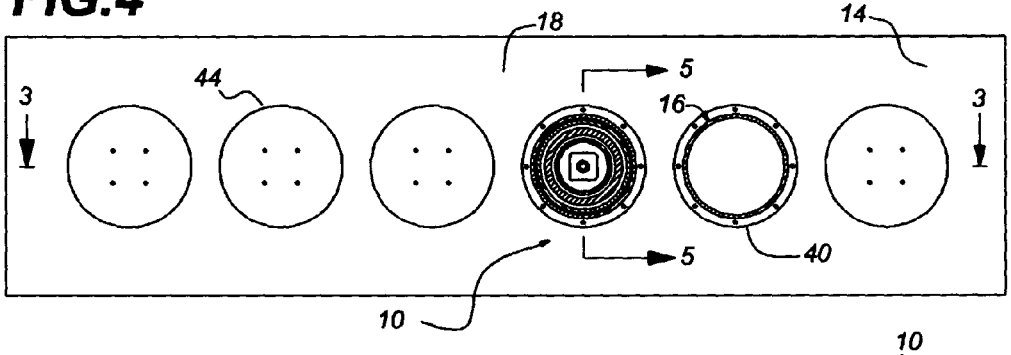
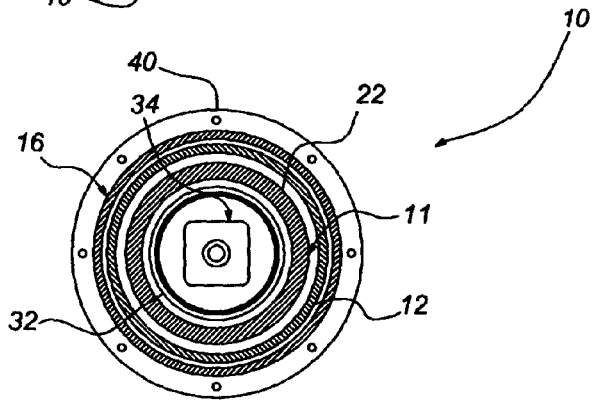
FIG.5

44

4 Operator
11
V1
ATM
62
V2
P
70
3 Operator
82
34
72
Up
Dn
12
2 Operator
V3
ATM
64
V4
P
28
1 Operator

ANTI-TERRORIST ROAD BLOCK

This application claims the benefit of U.S. Provisional Patent Application No. 60/403,997, filed Aug. 17, 2002.

STATEMENT REGARDING FEDERALLY SPONSORED RESEARCH OR DEVELOPMENT

Not applicable

BACKGROUND OF THE INVENTION

This invention comprehends and provides for anti-terrorist structure in the form of a substantially indestructible, extensible and retractable barricade or road block to prevent unauthorized access into roads and entranceways, such as parking garages under buildings, and to provide security around buildings or other vulnerable structures. The form or arrangement of such structure being for control of, and immobilization of vehicular traffic.

Road block apparatus, such as swinging or hydraulically lifted gates; a cable and flexible barrier combination that is capable of nondestructively snaring and securing a vehicle until the occupants can be removed; and underground installed apparatus that telescope members to impede traffic into and out of parking lots, direct traffic as required or to reserve parking spaces are known to those skilled in the art. Many patented apparatus pertaining to this subject can be found in classes 404 and 409 of the U.S. Patent and Trademark Office.

Examples of some pertinent prior art patents are listed and discussed as follows:

U.S. Pat. No. 3,086,430, issued Apr. 23, 1963 to D. T. Emmel discloses extensible and retractable, flexible, post-like traffic markers adapted to be installed on roadways to instruct, guide and control traffic. This apparatus was intended to replace manual labor required for installing and removing rubber pylons, wooden barriers, concrete curbs and the like.

U.S. Patent No 4,320,380, issued Mar. 26, 1982 to Berard et al, teaches electronically controlled safety mechanism for a highway exit ramp, taking the form of sensor apparatus embedded in the roadway that is capable of detecting vehicle movement in the wrong direction and actuation of a swing-gate type barrier in order to impede a vehicle from entering an express way in the wrong direction.

U.S. Pat. No. 4,576,508, issued Mar. 18, 1986, to Harry D. Dickinson teaches a remotely controlled bollard trafficway barrier and vehicle arrest system comprised of a cast in place foundation and replaceable mounting frame to carry a lift means for a bollard, and with access for replacement of the bollard. The bollards are flush with the grade when retracted and are extended by fluid power and controls.

U.S. Pat. No. 4,715,742, issued Dec. 29, 1987, to Harry D. Dickinson was a co-pending application to his above patent. This patent covers much of the teachings included in his prior U.S. Pat. No. 4,576,508, but includes manual retraction instead of mechanically.

U.S. Pat. No. 6,099,200, issued Aug. 8, 2000, to Inventor Pepe et al, teaches an anti-terror security barrier to prevent unauthorized vehicles from entering a secure area around buildings. The device is manually operated and includes a telescoping bollard incorporated into a foundation embedded below the ground. A gas-charged spring lift mechanism extends the bollards. A locking mechanism secures the bollards in the extended and retracted positions.

U.S. Pat. No. 6,312,188 B1, issued Nov. 6, 2001, to Ousterhout et al, discloses a mobile, non-lethal, rapidly deployed vehicle immobilizer apparatus for impeding the forward motion of a land vehicle when associated supports are extended, the cable and flexible barrier arrangement will arrest the motion of the vehicle without damaging the vehicle or injuring the occupants.

All of the above cited prior patents, to one extent or another, contain the ability to impede vehicular traffic, however, none of them include all the features embraced in the instant application, including speed sensors and peripheral electronics that calculate the speed of an oncoming vehicle and makes a determination that the vehicle does or does not pose a threat or danger to the building or structure the instant road block is protecting. If the calculated speed of the vehicle is such that an impact with a building or entry into an underground parking area is imminent, the road block is instantaneously extended in order to dead stop the vehicle.

The instant road block apparatus includes an under grade, steel reinforced structural concrete foundation that contains an automatically actuated mechanism to extend or retract one or more heavy duty bollards capable of stopping most vehicles, and, peripheral electronic equipment capable of sensing the speed of an approaching vehicle.

If the electronic calculated speed poses no threat, an on duty operator can manually start an automatic, but much slower extension of the road block mechanism.

BRIEF SUMMARY OF THE INVENTION

This patent application is related to a road block apparatus, also called a bollard or bollard apparatus. In its preferred embodiment, at least one and preferably several of the bollards are housed underground and are employed in groups of multiple retractable and extensible bollards, jointly or severally arranged in a pattern to rapidly decelerate a moving vehicle to a dead stop.

Automatic extension of the bollards of the road block apparatus commences when an associated sensor detects a speeding, oncoming vehicle at a distance therefrom to enable sufficient remaining time during the small time interval required for the almost instantaneous extension of the road block apparatus of this invention, whereby, the road block apparatus is fully extended simultaneously with or before contact of the vehicle.

In order to achieve the unexpected almost instantaneous rate of extension of the bollard, the mass of the bollard is minimized to a value that is adequate to retain the structural integrity required for withstanding the shock of decelerating an oncoming vehicle while at the same time having the piston area of the power cylinder of a size to develop the required upthrust to achieve the required momentum (acceleration) to be fully extended prior to vehicle impact.

The rate of extension of the bollard from its housing is therefore selected manually by security personnel or alternatively can be selected depending on a judgement being electronically made of the criticality of a situation whereby the selection and extension of the bollard occurs almost instantaneously for a rapid deployment (fatal results), or a relatively slow deployment (non-fatal situation) wherein the rate of extension is based on statistical accumulated data and is computer controlled to remove any decision making from the judgement of individual human operatives. Hence, when it is ascertained by the computer that the action of a suspect vehicle conforms with the actions of a terrorist, or the like, the bollard extension occurs at an extremely rapid rate because it is evident that the vehicle is intent on causing destruction of lives and property. There may be instances where a critical situation requires immediate deployment of the bollard wherein a human operative simply is incapable of carrying out this sequence of events within the time constraint of this situation.

In the preferred embodiment, the bollard of this invention is housed underground with the upper extremity thereof flush with the roadway and is deployed in groups of multiple retractable and extensible bollards jointly or severally arranged in a pattern to rapidly decelerate almost any moving vehicle. The rate of extension of one or several of the bollards is one second or less. Heretofore, such a desirable achievement has not been considered possible, and accordingly, the road block of this invention measures up to the dignity of patentability and therefore represents a patentable concept.

More particularly, the electronic sensor devices that form part of this disclosure ascertain the presence of a vehicle accelerating greater than a predetermined rate of acceleration which if continued will achieve a velocity of 50 mph, for example, within a predetermined distance; and in response thereto commands the bollard to extend from the underground housing into the path of the accelerating vehicle, whereupon the vehicle will impact the bollard and is destructively decelerated, undoubtedly with fatal results to the passengers.

In the event that there is insufficient time available to rely on humans to manually achieve this manipulative action because of the lost motion associated with the reaction time of the human mind, along with the inherent hesitancy of some civilized persons taking action in a situation of this magnitude could render some humans incapable of successfully manually initiating operation of the present invention under the worse case situation.

It is known from actual experimental results that the bollard apparatus set forth in this disclosure can be extended in one second or less, while at the same time having sufficient structural integrity to withstand the impact of a 15,000 pound vehicle traveling at a speed of 50 mph. This has been achieved with the present invention, and, the bollard apparatus was found to remain intact and in operative condition shortly following the impact of a large, heavy test vehicle.

Accordingly, an object of the present invention is to provide a road block method and apparatus comprising a retracted bollard placed below a roadway surface to be extended into the path of an oncoming vehicle to arrest the travel of the vehicle within an unusually short distance and time frame.

Another object of the invention is the provision of a bollard apparatus, and a control system therefor, that commences to be extended into the path of a vehicle whenever such a vehicle is accelerating at a rate or at a velocity that places the vehicle in contact with the bollards no later than when the bollards have fully extended into the path of the speeding vehicle and preferably extended to a height of 36 inches above a roadway, for example, in order to arrest most any vehicle.

Still another object of this invention is the provision of a bollard that can be used as one of a plurality of bollards, wherein the bollards are reciprocatingly received within an under grade housing from which it is telescoped upward into the path of an oncoming vehicle to be arrested.

A further object of this invention is the provision of one or more bollards having a lift apparatus and a biasing means, wherein the biasing means overcomes the weight of the bollard and is biased upward upon release to extend the bollard and also to assist the a lift apparatus in extending the bollard so that the upward force of the lift apparatus, together with the biasing means extends the bollard in a minimum of time.

A still further object of this invention is the provision of a bollard assembly having a fast-acting lift apparatus actuated by fluid pressure and a biasing means in the form of a powerful spring, wherein the lift apparatus rapidly telescopes the bollard from a housing while the biasing means, when used alone, more slowly extends the bollard into the path of an oncoming vehicle.

Another and still further object of this invention is the provision of a fast-acting bollard assembly having a lift apparatus actuated by fluid pressure, and a biasing means for overcoming the static weight of the bollard, wherein, the lift apparatus rapidly telescopes the bollard upward from a housing while the biasing means augments the response rate of the bollard, and thereby extends the bollard into the path of an oncoming vehicle in a minimum of time, and wherein the housing is secured within the earth by a monolithic, steel reinforced, structural concrete base which transfers the force of impact into the surrounding earth.

Another and still further object of this invention is the provision of a reusable, fast-acting bollard assembly having sufficient strength and durability to withstand the impact of a heavy vehicle and soon thereafter be deployed again without requiring major repairs.

These and other objects and advantages of the present invention will become readily apparent to those skilled in the art upon reading the following detailed description and claims and by referring to the accompanying drawings.

The above objects are attained in accordance with the present invention by the provision of both method and apparatus fabricated in a manner substantially as described and claimed herein.

BRIEF DESCRIPTION OF THE SEVERAL VIEWS OF THE DRAWINGS

FIG. 3 is a part cross-sectional, part diagrammatical side view taken along line 3—3 of FIG. 4;

FIG. 4 is an enlarged, fragmentary, part cross-sectional, part schematical, plan view disclosing one arrangement of the apparatus previously disclosed in FIGS. 1–3;

FIG. 5 is a part cross-sectional, part schematical, top plan view of the invention and discloses additional details thereof;

DETAILED DESCRIPTION OF THE INVENTION

Figure 1:
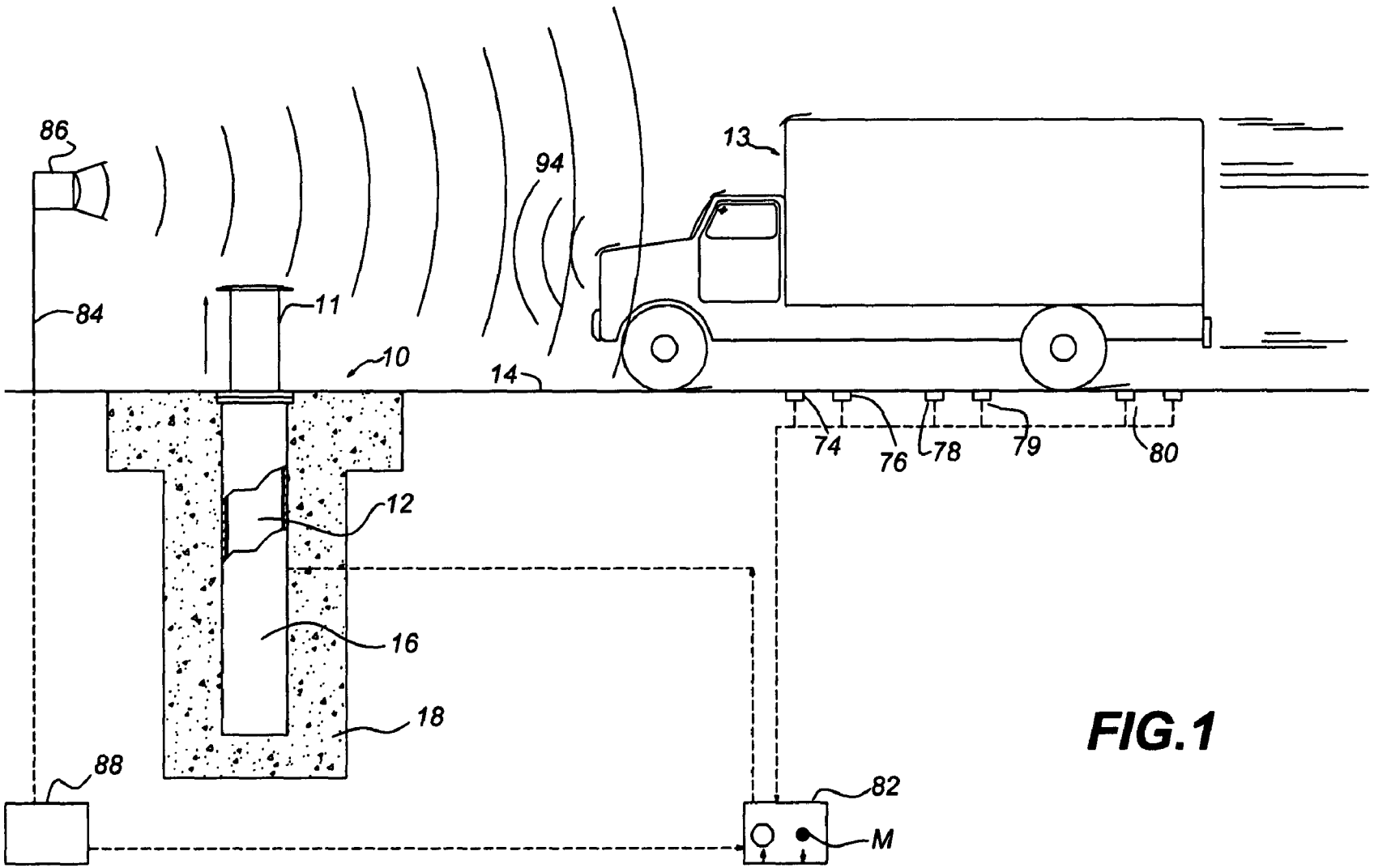
FIG. 1 is a part cross-sectional, part schematical, side view disclosing one possible arrangement of the invention.

The Figures of the drawings, and particularly FIG. 1, disclose a road block apparatus 10. The road block apparatus 10 is comprised of at least one, and preferably a plurality of retractable bollards 11 arranged in spaced relationship respective one another to present a pattern as illustrated in FIGS. 3 and 4, for example, in order to selectively prevent passage of a vehicle 13 therethrough.

The bollard 11, as particularly illustrated in FIGS. 1–5, together with other figures of the drawings, is extensible from a removable casing 12 (FIGS. 2 and 7) that is telescopingly received within the illustrated fixed or rigid outermost steel cylindrical housing, hereinafter referred to as the outermost anchor housing 16, or simply "housing 16". The outermost anchor housing 16 is rigidly encapsulated within the illustrated surrounding foundation comprised of a mass of cementatious material, such as steel reinforced structural concrete, as indicated by numeral 18. The road block apparatus 10 is located below the road surface 14 in a manner not to interrupt the ordinary flow of traffic through the area as illustrated in FIGS. 1, 3 and 4. The outer anchor housing 16 of the individual bollard apparatus of road block apparatus 10 is embedded within the illustrated steel reinforced, structural concrete base 18 to enable great impact forces to be transferred from bollard 11 into the surrounding strata of the earth 20. The rebar or steel reinforcement associated with the concrete preferably includes tensioned tendons that result in an almost indestructible design that can be considered a monolithic concrete, steel reinforced structure. Such a structure has been shown to survive the destructive impact of a vehicle traveling in the above described situation, and as will be more fully described later on herein.

Figure 2:
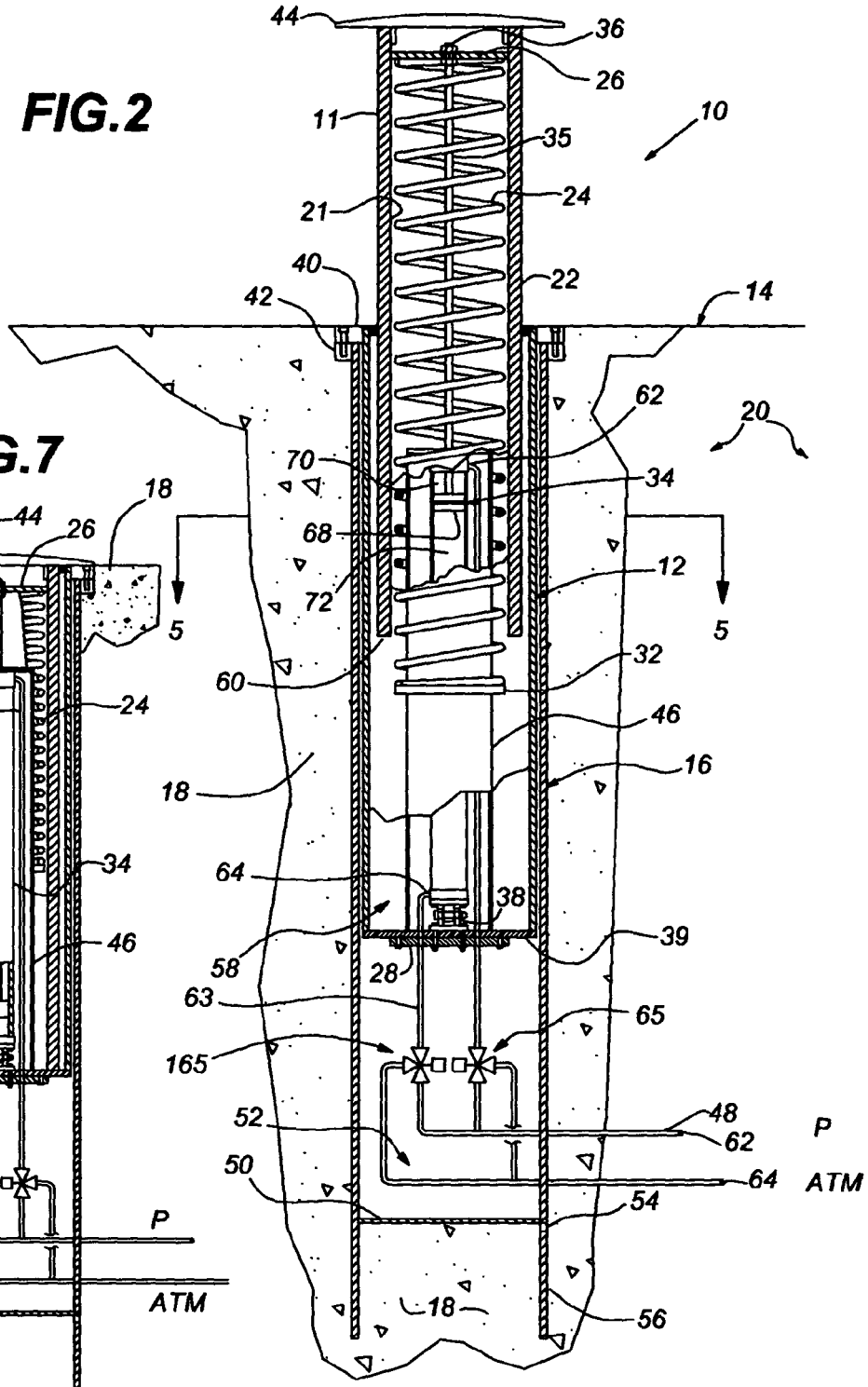
FIG. 2 is an enlarged part cross-sectional, part diagrammatical, part schematical, side view of some of the apparatus disclosed in FIG. 1.
Figure 7:
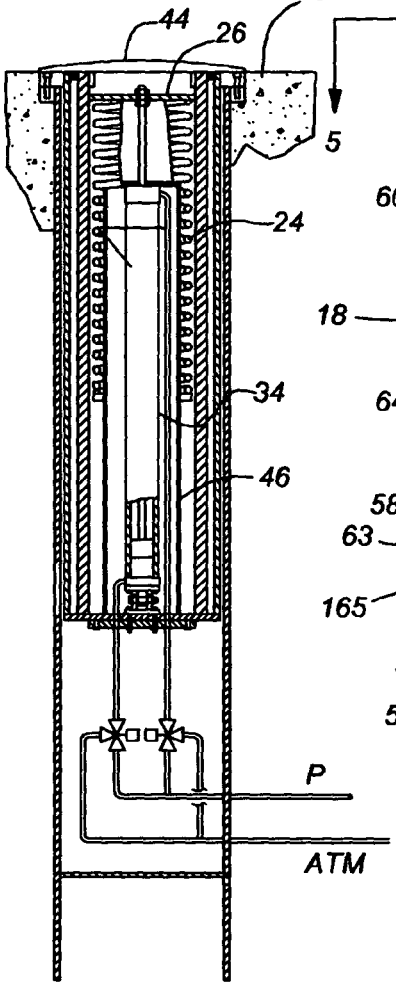
FIG. 7 is an enlarged, fragmentary, part cross-sectional, part schematical, side view disclosing part of one of the apparatus previously disclosed in FIGS. 1–6; and shown in the retracted configuration.
Figure 8:
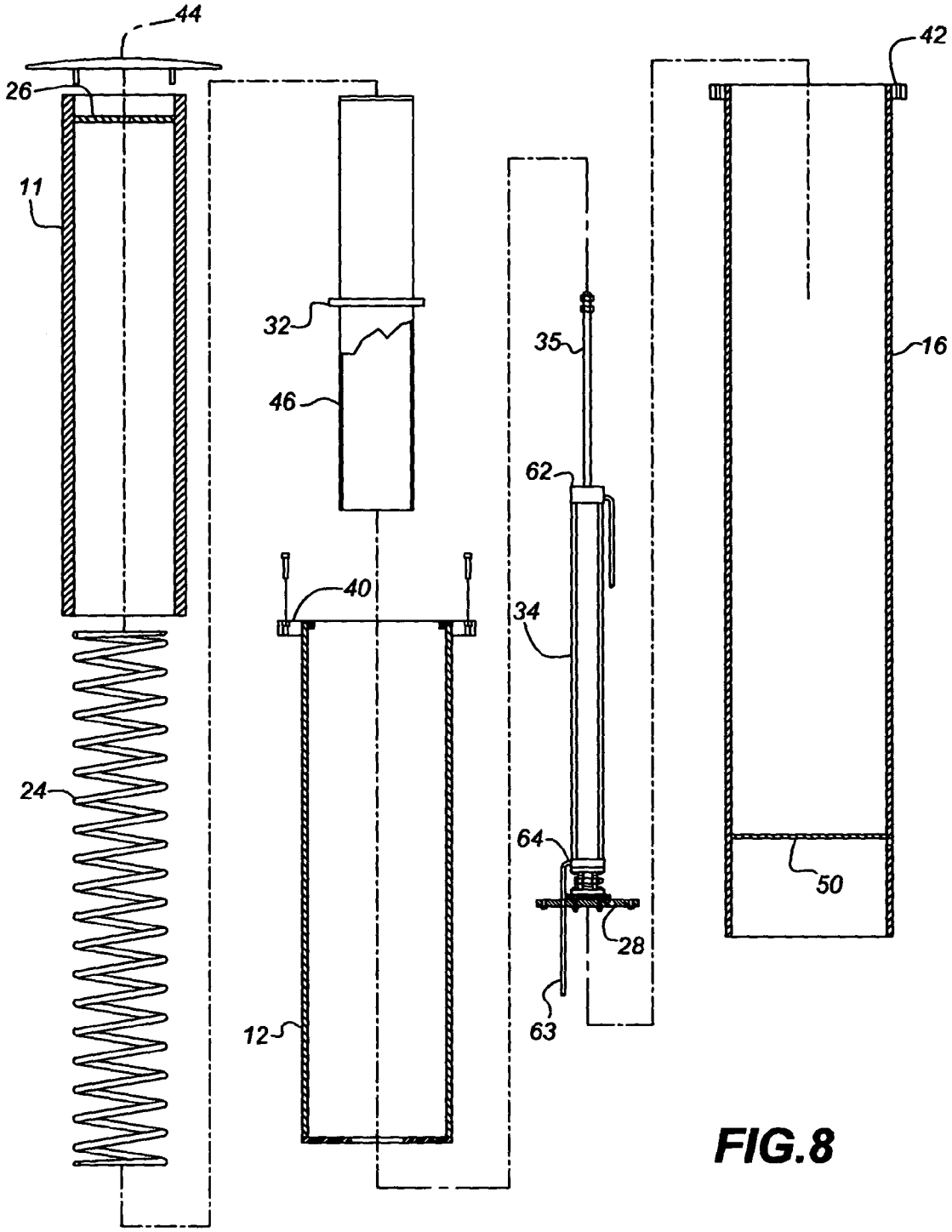
FIG. 8 is an enlarged, exploded, part cross-sectional, part schematical, side view disclosing most of the parts of the apparatus previously disclosed in FIGS. 1–7.

As seen in FIGS. 2 and 5, the outside diameter (OD) 22 of bollard 11 is telescopingly received within the removable casing 12 and is reciprocated respective removable casing 12 in accordance with the magnitude of a lifting and lowering force imposed on the bollard by a source of stored energy provided by biasing means disclosed herein as a power spring 24, for example, in conjunction with a power lift, disclosed herein as a power lift 34. The power spring 24, upon command, is actuated to release stored energy in accordance with the teachings of this disclosure. The action of power spring 24 alone will provide adequate lift to slidably telescope bollard 11 from the retracted position of FIGS. 3, 6 and 7 into the extended position of FIGS. 1 and 2 in a time interval that exceeds one second and preferably requires several seconds, which ordinarily is slow enough to render little if any harm to those who have good reason to be in proximity of road block apparatus 10. The inside diameter (ID) 21 of bollard 11 guidably receives power spring 24 therein as seen in FIGS. 2, 7 and 8.

In order to render the response rate of road block apparatus 10 fast and lethal, power spring 24 is augmented with a more powerful, faster acting biasing force derived from a double acting pressure actuated power lift apparatus 34 according to the following co-acting devices uniquely employed herein for accelerating bollard 11 upwardly in a manner heretofore unknown to those skilled in the art. It is possible that bollard 11 can attain the fully extended configuration within a time interval of one second, or less, according to the design and operation taught and claimed in the disclosure of this patent application.

Within outer anchor housing 16 is disposed a removable casing 12 having an upper plate 26 axially aligned and spaced from a lower closure plate 39, with there being opposed axially aligned cup members (not shown) having an inside diameter that snugly receives the terminal end portions of a power spring 24 there-within. Hence, there is an upper plate 26 arranged in opposition to plate 28 that is spaced therefrom, and to which the opposed ends of a double acting pneumatic or hydraulic power lift 34 are attached, all of which are axially aligned along the longitudinal central axis with respect to one another.

The double acting air or hydraulically actuated power lift 34 telescopingly receives a reciprocating operating piston shaft 35, the distal end of which extends therefrom and terminates in the illustrated upper fastener 36. Alternatively, upper fastener 36 can be attached to upper plate 26 by a clevis and yoke arrangement similar to the lower collar clevis and yoke 38, all of which operates to accelerate bollard 11 at a response rate proportional to the pressure differential imposed across power piston 68 of power lift 34. Lower yoke 38 connects the bottom of power lift 34 to the illustrated lower closure plate 39. Closure plate 39 is in the form of a flange, and is welded to the bottom of removable casing 12. Flange 40 is opposed to and confronts flange 42 to form an abutment at the upper terminal end of removable casing 12; flange 40 being affixed to removable casing 12 and flange 42 being welded to the top of outermost anchor housing 16. Flange 40 is provided with lifting eyes (not shown) to provide a lifting means for removing casing 12 and bollard 11 from the outer anchor housing 16. Closure plate 39 is a hold down for bollard 11, removable casing 12 and contents thereof, and thereby transfers its loads to the outer anchor housing or container 16.

An abutment can be placed on the outer surface of the bollard at a location to intercept and engage the abutment seen on flange 40 of FIG. 2. It is preferred that the piston travel is selected to provide the desired extension of the bollard wherein the piston abuttingly engages the top and bottom ends of the power lift cylinder.

Cover 44 is seated within a recess and provides a relatively smooth level surface which substantially is a continuation of road surface 14. A centralizer 46 together with power spring 24 maintains the bollard assembly centrally aligned along the longitudinal central axis of the apparatus, thus enabling the fast working parts to co-operate as detailed herein.

A closure plate 50, welded or otherwise attached to a lower end portion of the outermost anchor housing 16, forms a dry chamber 52 respective to the bottom of the outermost anchor housing 16. Further, outermost anchor housing 16 is apertured as seen at 54 to assure that the housing skirt 56 is secured by the steel reinforced concrete such that the entire mass of concrete within which the bollard assembly is anchored presents a strong monolithic structure.

Note that an upwardly extending annular area 58 commencing at the before mentioned closure plate 39 receives the lower marginal end 60 of bollard 11 therewithin when the apparatus is moved into the retracted position of operation.

As best shown in FIG. 2, a fluid (compressible or non-compressible) flow line 62 is attached to both of the three position control valves 65, 165 and form the valve means claimed herein. Each valve of the valve means is selectively connectable to the lower chamber 72 and upper chamber 70 of the double acting power lift 34 operable responsive to the flow paths jointly provided by the three position control valves 65, 165. The control valves 65, 165 selectively admit power fluid (air or hydraulic fluid) to flow into and out of lower chamber 72 and upper chamber 70 of power lift 34, as will be more fully appreciated later on herein. Spent power fluid flow line 64 is similarly attached to the other three position control valve 65 and to the upper chamber 70 of power lift 34 for selectively admitting power fluid flow into and out of the upper end of upper chamber 72 thereof, depending on the position selected for control of the fluid circuitry, and this too will be more fully appreciated later on herein.

Figure 6:
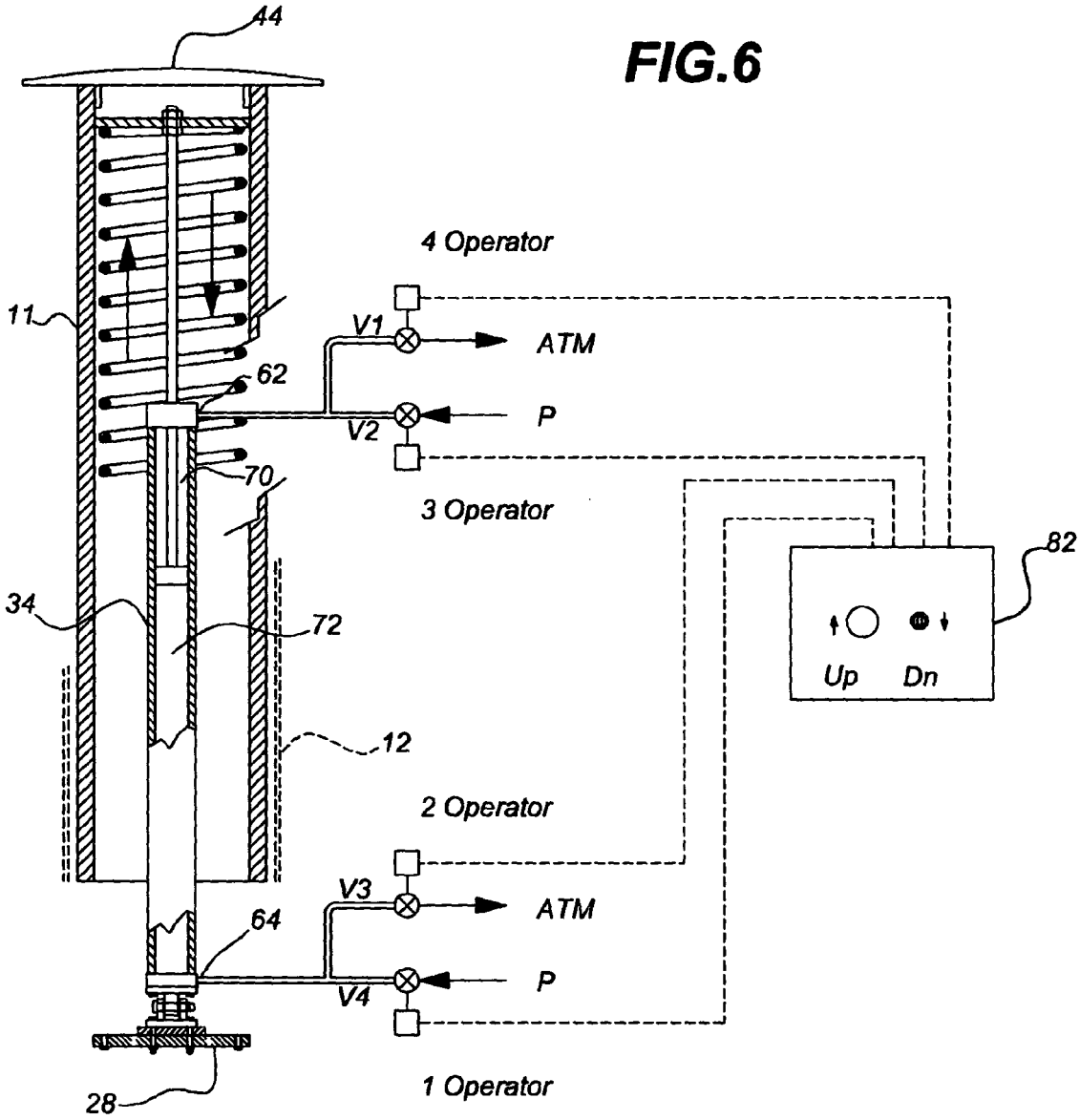
FIG. 6 is a part cross-sectional, part diagrammatical side view illustration of part of the apparatus of the foregoing figures and shows some of the operational details thereof.

FIG. 6 is a simplified diagrammatical illustration of the bollard apparatus, wherein the previous three position control valve 65 of FIG. 2 is illustrated by separate valves V1, V2, with V1 being connected to exhaust pressure for bleed down, while valve assembly V2 is connected to a source "P" of relatively high pressure for bollard retraction as well as deceleration of the bollard near the end of its upward travel.

Three position control valve 165 is likewise shown as valves V3, V4, respectively, connected to exhaust and to a pressure source, respectively. Each three position control valve 65, 165, respectively, of FIG. 2, therefore provides for bollard operation in the illustrated manner of the two sets of two separate valves V1, V2 and V3, V4, respectively, for controlled power fluid flow to and from hydraulic or pneumatic flow lines 62, 64 (FIG. 2) and thereby control the extension and retraction of bollard 11, as best seen in FIGS. 2 and 6 of the drawings. Valves V1, V2 and V3, V4 preferably are solenoid actuated valves having a fast response rate to reduce the desired time interval during bollard extension to a minimum.

The valve control box 82 of FIGS. 1 and 6 encloses circuitry by which valves V1–V4 and valves 65, 165 of FIG. 6 are actuated manually or by computer 88 of FIG. 1. The valve means of this system is connected to control flow of power fluid from a source "P" to valve V2 while valve V1 opens to controllably exhaust the chamber above power piston 68 to an accumulator (not shown) or to the atmosphere. Valves V1, V2 and V3, V4, as well as the three position control valves 65, 165, selectively control flow from pressure source "P" through the illustrated fluid line into upper chamber 70 of power lift 34; and for return flow along the flow line to the atmosphere or hydraulic accumulator for bleed down.

Still looking at FIGS. 2 and 6, together with other Figures of the drawings, power piston 68 of power lift means 34 is attached to the lower end of piston shaft 35 and thereby divides the double acting power cylinder of the power lift means into upper and lower chambers 70 and 72, respectively, with the chambers being connected to the before mentioned three position control valves 65, 165 at flow lines 62, 64, respectively, for control of the piston action of the double acting power lift 34, for retraction and extension of each bollard 11 in accordance with this invention.

It should now be appreciated that the valve means of this disclosure provides for the following manipulation of the bollard action:

1. Standby: Wherein the spring and piston are continually forced downward in order to maintain the bollard safely retracted by power fluid applied in upper chamber 70.

2. Slow extension of the bollard using the spring force action by equalizing fluid pressure across the piston (bleed down of upper chamber 70).

3. Reset: The extended bollard is reset (moved to the standby configuration) by applying fluid to the upper chamber while reducing power fluid in the lower chamber, thus driving the piston downward.

4. Fast extension. Power fluid is removed from the upper chamber while simultaneously power fluid is applied to the lower chamber thereby using both spring force and power lift force to extend the bollard into operative configuration. When the bollard is extended at its maximum rate, the bollard is decelerated toward the end of its travel to avoid damage to the abutments. Pressure differential across the piston is maintained to assure the spring force maintains the bollard extended.

5. Throttling. The valves can be throttled when deemed desirable to control the rate of extension and retraction.

FIGS. 2 and 7 jointly disclose the computer controlled automatic extension of bollard 11 from the illustrated retracted position seen in FIGS. 3 and 7, into the extended position seen in FIGS. 1 and 2.

In FIG. 1, signals generated by several buried, spaced speed detectors 74–80 are connected to valve control box 82 and computer 88 for sensing the speed and rate of acceleration of a vehicle 13 by comparing the time intervals between each of the adjacent buried, spaced speed detectors 74–80. This instantaneous derivation is logically used to determine the immediate action that the system should initiate in actuating the three position control valves 65, 165 or V1, V2, V3, V4 in the manner taught herein, to extend the bollard commencing within an almost zero time interval of delay; whereupon the computer immediately actuates the three position control valves 65, 165 to place a large pressure differential across power piston 68 of power lift 34. Bollard 11 almost instantaneously commences to extend from its protective removable casing 12 and acquires its extended position, whereupon it intercepts and decelerates the oncoming vehicle 13 to a dead stop. The arresting force of the extended bollard is of such a magnitude that several feet of the forward part of the vehicle will be invaded by the bollard, as the engine of the vehicle is violently relocated rearwardly, thus spreading the force of the impact over a longer time interval, thereby adding to the survival of the bollard apparatus.

In FIG. 1, the valve control box 82 for manually operating selected bollards 11 is provided in conjunction with the speed detector sensor apparatus 74–80, jointly or severally. A security enclosure at 84 supports antenna 86 which is located to maintain surveillance over the critical area illustrated in FIG. 1. Each of the sensors is connected to computer 88 and provides for the safe operation of the road block apparatus. Alternatively, the antenna 86 can be a radar antenna for measuring the velocity and acceleration of the vehicle 13, as indicated by numeral 94. Radar or the like can be used in conjunction with or separate from speed detectors 74–80. In actual practice, the switch means for actuating the multiple bollards have been manually operated successfully.

DISCUSSION OF THE OPERATION OF THE FIGURES OF THE DRAWINGS

In order to achieve the unexpected almost instantaneous rate of extension of the bollard, the mass of the bollard is minimized to a value that is adequate to retain the structural integrity required for withstanding the shock of decelerating an oncoming vehicle while at the same time having the piston area of the power cylinder of a size to develop the required upthrust to achieve the required momentum (acceleration) to be fully extended prior to vehicle impact.

The weight of the bollard is overcome by power spring 24 which imparts a negative value of bollard weight that is attributed to the spring force being arranged to fully extend the bollard at a relatively slow rate when no pressure differential is imposed across the piston due to the spring force always being compressed to lift the bollard.

Those skilled in the art, having digested all of the disclosure material herein, will appreciate that this invention includes apparatus and methods by which the following sequence of events may be carried out:

1. Providing a dictionary of stored terms related to a profile of a vehicles' actions when operated by a terrorist; wherein the profile includes the various actions expected of the vehicle during the time immediately prior to the consummation of a mission; this being considered a critical situation.
2. Providing a dictionary of stored terms related to a profile of a vehicle operated by a law abiding citizen wherein the profile includes the various actions expected of the vehicle during normal driving conditions for the particular area involved.
3. Storing data related to the actions of a vehicle as it approaches the security area; and comparing the last said stored data 3 to the stored data profile of 1 and 2 above; and,
4. Whenever said comparison of said vehicle profile 3 with said dictionary of stored terms 1 and 2 indicates a critical situation is present; extension of the bollards automatically commences with the on-coming vehicle being at a distance that provides sufficient time for the almost instantaneous extension of the road block apparatus; whereby, the bollards of the road block apparatus are fully extended simultaneously with or before contact of the vehicle.
5. Alternatively, whenever a time constraint is not critical, after step 3 has been completed, should said comparison be inconclusive, the road block of this disclosure is more slowly actuated; whereby the bollards of the roadblock are extended during a time interval that enables the vehicle to decelerate and stop prior to encountering the road block;
6. In any event, the road block of the present invention is rapidly actuated into the extended position whenever said comparison of said vehicle profile with said dictionary of stored knowledge indicates a critical situation is present; with the extension of the bollards commencing with the on-coming vehicle being at a distance that provides sufficient time for the almost instantaneous extension of the road block apparatus; whereby, the bollards of the road block apparatus are fully extended simultaneously with or before contact of the vehicle. Accordingly, the invention provides a road block comprising automatically actuated bollards that commence to be extended whenever a vehicle is accelerating at a velocity that places the vehicle in contact with the bollards no later than when the bollards have extended approximately 36 inches.

EXAMPLE

This desirable road block apparatus and method is achieved by a telescopingly arranged bollard received within a housing that is rigidly installed below the surface of the roadway. The bollard is extended, upon command, into the path of an oncoming, over speeding vehicle which crashes into the bollard as the vehicle is destructively decelerated and destroyed due to the sudden arresting thereof.

This invention includes anti-terrorist road block method and apparatus by which the following sequence of events may be carried out:

1. Measuring the velocity and acceleration of a vehicle approaching a designated area. Should the measured speed of the approaching vehicle be in excess of a selected or pre-determined speed, (50 mph, for example) immediate actuation of visual and audible warning devices are given.
2. Simultaneously or thereafter, should the vehicle continue to accelerate at a predetermined rate that indicates it soon will reach an unacceptable speed or acceleration, the road block of the present invention is actuated.
3. Extension of the road block apparatus commences when the oncoming vehicle is at a distance therefrom to enable sufficient remaining time during the small time interval required for the almost instantaneous extension of the road block apparatus of this invention, whereby, the road block apparatus are fully extended simultaneously with or before contact of the vehicle. For example, a vehicle approaching a 25 mph speed zone of a security area exceeds 25 mph, flashing lights and audible sounds may be directed toward the vehicle, and the vehicle slows down below 25 mph. The road block remains retracted during this situation.

On the other hand, should the vehicle fail to slow down but is below the critical speed limit, the road block bollard is slowly extended should ample time remain to do so.

However, at any time, should said comparison of said vehicle profile (data related to vehicle actions) with said dictionary of stored knowledge indicate a critical situation is present, the bollards of the road block apparatus are immediately fully extended.

Further, at any time during an uncritical situation, the controller personnel can manually actuate the road block independently of the computer. The computer always overrides the manual operation whenever a critical situation develops of which the personnel may be unaware, except for emergency shut-down.

Those skilled in the art, having digested this disclosure in its entirety, will appreciate that the bollards, when not extended, are in the standby or safe configuration, with valves V1, V2, V3, and V4 being set whereby pressure effected in the upper power piston chamber of the power lift 34 exceeds the stored energy of the actuating spring, and accordingly the spring remains in the fully collapsed or retracted configuration. In order to slowly extend the bollard, pressure is bled off the upper chamber of the power cylinder, until the stored energy of the spring force extends the bollard. The bollard remains extended so long as the valves are set to maintain zero pressure differential across the power piston, and when reset is desired, pressure is re-applied to the upper chamber of the power piston by manipulating control valves 65, 165 to retract power piston 68 within power lift 34.

Hence, the bollard is retracted by applying sufficient pressure to upper power piston chamber 72 to move power lift 34 and bollard 11 against power spring 24, thus resetting the bollard apparatus.

The bollard is rapidly extended by simultaneously actuating the valves in a manner to bleed the upper piston chamber while quickly applying high pressure to the lower piston chamber.

It will be apparent to those skilled in the art that the weight of the bollard is overcome by power spring 24 which imparts a negative value of bollard weight and this is attributed to the spring force being arranged to fully extend the bollard at a relatively slow rate when no pressure differential is imposed across the piston due to the spring force always being compressed to lift the bollard.

In order for the bollard to accelerate within the desired time interval to intercept an on-coming vehicle, it is necessary to accelerate the bollard to a velocity that will damage the upper stop unless it is decelerated near the end of its travel. This deceleration step is achieved by increasing the upper piston chamber pressure as a result of changing the relationship of the three position control valves 65, 165 to decrease the pressure in the lower piston chamber 75 while increasing the pressure within upper chamber 70. Otherwise the bollard impacts the upper stop with damaging force. Hence the pressure differential across the piston is a maximum at the beginning of its upstroke, and is arrested toward the end of the upstroke by an opposite force applied on the upper piston chamber.

Therefore, the valve system first exposes the bottom of the piston to relatively high lifting pressure differential upon extension followed by the application of a cushion which is achieved by high pressure being effected at the top of the piston during the arresting part of the bollard extension.

Example: a 10.75 inch diameter bollard having a total length of 6 feet to provide a stroke of 36 inches has a spring force that fully extends the bollard in the absence of any pressure differential. Rapid extension of the bollard is realized by application of 120 psi pressure differential, allowing the upper chamber to exhaust during the initial acceleration of the bollard, followed by closing the exhaust valve while opening the upper pressure valve to commence deceleration.

CATALOG OF PARTS

10 road block apparatus
11 bollard
12 removable casing
13 vehicle
14 road surface
16 outermost anchor housing
18 steel reinforced concrete
20 strata of the earth (below 14)
21 inside diameter (of bollard 11)
22 outside diameter (of bollard 11)
24 power spring (stored energy to lift bollard)
26 upper plate
28 plate
32 spring stop
34 power lift (air or hydraulic double acting cylinder assembly)
35 piston shaft (of power lift)
36 fastener (upper fastener for 35)
38 lower yoke (lower fastener or yoke for 34
39 closure plate (welded to bottom of removable casing 12)
40 flange (on top of removable casing 12)
42 flange (on top of outer anchor housing
44 cover (bolted to 11)
46 centralizer
48 fluid flow line
50 closure plate (at bottom of outer anchor housing)
52 dry chamber
54 aperture (forms skirt at bottom of outer anchor housing 16)
56 housing skirt (at bottom of outermost anchor housing)
58 annular area
60 lower marginal end (of bollard 11 in the retracted position)
62 flow line
63 flow line
64 fluid flow line
65 & 165 3 position control valve
68 power piston
70 upper chamber
72 lower chamber
74–80 (spaced buried speed detectors)
82 valve control box (for manually or automatically operating selected bollards)
84 security enclosure (for radar antenna 86)
86 radar (antenna connected to computer 88)
88 computer 88
94 radar signal

We claim:

1. An apparatus comprising:
a foundation located below a roadway surface;
a housing secured to the foundation;
a bollard reciprocatingly received within the housing;
a plate disposed within the bollard;
a spring reciprocatingly received within the bollard, and secured at a proximal end to the plate;
a cylinder received at least in part within the spring;
a piston shaft reciprocatingly received within the cylinder, which piston shaft is secured at a proximal end to the plate;
a piston terminating a distal end of the piston shaft, which piston divides the cylinder into an upper chamber and a lower chamber;
a flow line;
a valve system; and
circuitry connected to the valve system, which circuitry is operable to simultaneously or sequentially operate the valve system so as to selectively connect the flow line for operation on the lower chamber and the upper chamber, which operation on the upper chamber and the lower chamber causes reciprocation of the spring between compressed and extended positions, and which compression and extension of the spring causes reciprocating of the bollard between retracted and extended positions.

2. The apparatus of claim 1 wherein the foundation comprises reinforced cementitious material.

3. The apparatus of claim 2 wherein:
the foundation transfers the force of impact on a bollard in an extended position to the ground surrounding the foundation.

4. The apparatus of claim 2 wherein:
the foundation comprises tensioned tendons.

5. The apparatus of claim 1 wherein:
the valve system has an operative position that causes the flow line to exhaust pressure from at least one of the lower chamber and the upper chamber to equalize the pressure between the lower and upper chambers.

6. The apparatus of claim 5 wherein:
the equalization of pressure between the upper and lower chambers causes the spring to move from a compressed position to an extended position.

7. The apparatus of claim 1 wherein:
the valve system has an operative position that causes the flow line to apply pressure into the upper chamber.

8. The apparatus of claim 7 wherein:
the application of pressure into the upper chamber causes the spring to move into a compressed position.

9. The apparatus of claim 1 wherein:
the valve system has an operative position that causes the flow line to apply pressure into the upper chamber and exhaust pressure from the lower chamber.

10. The apparatus of claim 9 wherein:
the operative position causes the spring to move into a compressed position.

11. The apparatus of claim 1 wherein:

the valve system has an operative position that causes the flow line to apply pressure into the lower chamber and exhaust pressure from the upper chamber.

12. The apparatus of claim 11 wherein:

the operative position causes the spring to move into an extended position.

13. The apparatus of claim 12 wherein:

the movement of the spring into an extended position causes the bollard to extend at a rate responsive to the magnitude of the pressure differential imposed across the piston.

14. The apparatus of claim 12 wherein:

the valve system has a second operative position that exhausts pressure from the upper chamber at the beginning of bollard extension, and thereafter applies pressure into the upper chamber prior to the termination of the bollard extension to thereby decelerate the bollard as the bollard nears the end of its extension.

15. The apparatus of claim 1 further comprising:

a sensor arranged to detect a vehicle approaching the apparatus, which sensor is operable to activate the circuitry to move the bollard into an extended position within a time frame that intercepts the approaching vehicle.

16. The apparatus of claim 15 wherein:

the sensor comprises a detector operable to determine whether a vehicle approaching the apparatus is accelerating at a rate greater than a predetermined rate of acceleration.

17. The apparatus of claim 1 further comprising:

a centralizer received at least in part within the spring.

18. The apparatus of claim 1 further comprising:

a casing received within the housing, which casing reciprocatingly receives the bollard.

19. The apparatus of claim 18 further comprising:

an abutment between the bollard and the casing for limiting extension and retraction of the bollard.

20. The apparatus of claim 1 wherein:

the apparatus is substantially underground when the bollard is in a retracted position.

21. A method comprising:

providing a foundation located below a roadway surface;

securing a housing to the foundation;

reciprocatingly placing a bollard within the housing;

disposing a plate within the bollard;

reciprocatingly placing a spring within the bollard;

securing a proximal end of the spring to the plate;

placing a cylinder at least in part within the spring;

reciprocatingly placing a piston shaft within the cylinder;

securing the piston shaft at a proximal end to the plate;

providing a piston at a distal end of the piston shaft, which piston divides the cylinder into an upper chamber and a lower chamber;

providing a flow line;

providing a valve system;

operably connecting circuitry to the valve system to simultaneously or sequentially operate the valve system so as to selectively connect the flow line for operation on the lower chamber and the upper chamber, which operation on the upper chamber and the lower chamber causes reciprocation of the spring between compressed and extended positions, which compression and extension of the spring causes reciprocating of the bollard between retracted and extended positions.

22. The method of claim 21 wherein the:

foundation comprises reinforced cementitious material, which underground foundation has an upwardly opening chamber terminating near the surface of the ground; and securing the housing in the chamber.

23. The method of claim 22 further comprising:

using the foundation to transfer the force of impact on a bollard in an extended position to the ground surrounding the foundation.

24. The method of claim 21 further comprising:

operating the valve system in an operative position that causes the flow line to exhaust pressure from the lower chamber to equalize the pressure between the upper and lower chambers.

25. The method of claim 24 wherein:

the equalization of pressure between the upper and lower chambers causes the spring to move from a compressed position to an extended position.

26. The method of claim 21 further comprising:

operating the valve system in an operative position that causes the flow line to apply pressure into the upper chamber.

27. The method of claim 26 wherein:

the application of pressure into the upper chamber causes the spring to move into a compressed position.

28. The method of claim 21 further comprising:

operating the valve system in an operative position that causes the flow line to apply pressure into the upper chamber and exhaust pressure from the lower chamber.

29. The method of claim 28 wherein:

the operative position causes the spring to move into a compressed position.

30. The method of claim 21 further comprising:

operating the valve system in an operative position that causes the flow line to apply pressure into the lower chamber and exhaust pressure from the upper chamber.

31. The method of claim 30 wherein:

the operative position causes the spring to move into an extended position.

32. The method of claim 31 wherein:

the movement of the spring to an extended position causes the bollard to extend at a rate responsive to the magnitude of the pressure differential imposed across the piston.

33. The method of claim 31 further comprising:

operating the valve system in a second operative position that exhausts pressure from the upper chamber at the beginning of bollard extension, and thereafter applies pressure into the upper chamber prior to the termination of the bollard extension to thereby decelerate the bollard as the bollard nears the end of its extension.

34. The method of claim 21 further comprising:

operating the valve system in a first operative position that causes the flow line to apply pressure into the upper chamber, which application of pressure into the upper chamber causes the spring to reside in a compressed position.

35. The method of claim 34 further comprising:

operating the valve system in a second operative position that causes the flow line to exhaust pressure from the upper chamber to equalize the pressure between the upper and lower chambers.

36. The method of claim 35 wherein:

the equalization of pressure between the upper and lower chambers causes the spring to move from a compressed position to an extended position.

37. The method of claim 36 further comprising:

operating the valve system in a third operative position that causes the flow line to apply pressure into the upper chamber, which application of pressure into the upper chamber causes the spring to move from an extended position to a compressed position.

38. The method of claim 37 further comprising:

causing the flow line to exhaust pressure from the lower chamber.

39. The method of claim 34 further comprising:

operating the valve system in a second operative position that causes the flow line to apply pressure into the lower chamber and exhaust pressure from the upper chamber.

40. The method of claim 39 wherein:

the second operative position causes the spring to move from a compressed position to an extended position.

41. The method of claim 40 wherein:

the movement of the spring to an extended position causes the bollard to extend at a rate responsive to the magnitude of the pressure differential imposed across the piston.

42. The method of claim 40 further comprising:

operating the valve system in a third operative position that causes the flow line to exhaust pressure from the upper chamber at the beginning of extension of the spring, and thereafter apply pressure into the upper chamber prior to termination of the extension of the spring to thereby decelerate movement of the bollard from a retracted to an extended position.

43. The method of claim 42 further comprising:

operating the valve system in a fourth operative position that causes the flow line to apply pressure into the upper chamber, which application of pressure into the upper chamber causes the spring to move from an extended position to a compressed position.

44. The method of claim 43 further comprising:

causing the flow line to exhaust pressure from the lower chamber.

45. The method of claim 40 further comprising:

operating the valve system in a third operative position that causes the flow line to apply pressure into the upper chamber, which application of pressure into the upper chamber causes the spring to move from an extended position to a compressed position.

46. The method of claim 45 further comprising:

causing the flow line to exhaust pressure from the lower chamber.

47. The method of claim 21 further comprising:

providing a sensor to detect an approaching vehicle; and activating the circuitry in response to the detection of the vehicle to reciprocate the bollard into the extended position within a time frame that intercepts the approaching vehicle.

48. The method of claim 21 further comprising:

placing a centralizer at least in part within the spring; and receiving the cylinder within the centralizer.

49. The method of claim 21 further comprising:

placing a casing within the housing; and reciprocatingly placing the bollard within the casing.

* * * * *